US012497086B2

(12) United States Patent
van Maarschalkerweerd et al.

(10) Patent No.: US 12,497,086 B2
(45) Date of Patent: Dec. 16, 2025

(54) INTERFACE ADAPTER FOR CONTROLLING A TRACK-SIDE OBJECT OF A RAILWAY INSTALLATION

(71) Applicant: Pilz GmbH & Co. KG, Ostfildern (DE)

(72) Inventors: Carlus van Maarschalkerweerd, Ostfildern (DE); Willem Sonneveldt, Ostfildern (DE)

(73) Assignee: Pilz GmbH & Co. KG, Ostfildern (DE)

( * ) Notice: Subject to any disclaimer, the term of this patent is extended or adjusted under 35 U.S.C. 154(b) by 542 days.

(21) Appl. No.: 18/068,120

(22) Filed: Dec. 19, 2022

(65) Prior Publication Data

US 2023/0192162 A1 Jun. 22, 2023

(30) Foreign Application Priority Data

Dec. 20, 2021 (EP) ..... 21216115

(51) Int. Cl.
*B61L 19/06* (2006.01)
*B61L 7/08* (2006.01)

(52) U.S. Cl.
CPC ..... *B61L 19/06* (2013.01); *B61L 7/08* (2013.01); *B61L 2019/065* (2013.01)

(58) Field of Classification Search
CPC ..... B61L 19/06; B61L 7/08; B61L 2019/065
See application file for complete search history.

(56) References Cited

U.S. PATENT DOCUMENTS 8,028,961 B2 10/2011 Ashraf
8,306,680 B2 11/2012 Schwenkel
(Continued)

FOREIGN PATENT DOCUMENTS

DE 102007039154 A1 2/2009
EP 2452237 B1 5/2012
(Continued)

OTHER PUBLICATIONS

English translation of FR-3042928-A1 (Year: 2020).*
(Continued)

*Primary Examiner* — Henry Tsai
*Assistant Examiner* — John B Roche
(74) *Attorney, Agent, or Firm* — Miller Johnson

(57) ABSTRACT

An interface adapter for controlling a track-side object of a railway installation includes an analog input from an external source and an analog output to drive an electromechanical relay circuit. A bidirectional digital communication interface communicates digital data including first digital data transmitted and second digital data received. An analog-to-digital converter coupled to the analog input is configured to generate a first digital signal representing the electrical input. A digital-to-analog converter coupled to the analog output is configured to generate the electrical output in response to a second digital signal. A power supply supplies electrical power to the digital-to-analog converter. A programmable logic control circuit includes a control program configured to produce the first digital data from the first digital signal, transmit the first digital data using the digital communication interface, process the second digital data, and produce the second digital signal in response to the second digital data.

15 Claims, 1 Drawing Sheet

(56) References Cited

U.S. PATENT DOCUMENTS

| | | | | |
|---|---|---|---|---|
| 10,700,700 | B1 * | 6/2020 | Shamee | H03M 3/468 |
| 2004/0089346 | A1 * | 5/2004 | Sutardja | A01G 25/16 137/377 |
| 2019/0302571 | A1 * | 10/2019 | Betts | H03M 1/1245 |

FOREIGN PATENT DOCUMENTS

| | | | | |
|---|---|---|---|---|
| EP | 3539845 | A1 | 9/2019 | |
| FR | 3042928 | A1 * | 4/2017 | H03M 1/742 |

OTHER PUBLICATIONS

Monique Voorderhake et al: ProRail und Industriepartner bauen den ersten EULYNX-Demonstrator; Signalling + DataCommunication (111) 7+8 / 2019.

SBB AG: Grundkonzept für den smartrail 4.0 Object Controller—Öffentliche Kurzversion; https://www.voev.ch/de/Service/content_?download=18090.

* cited by examiner

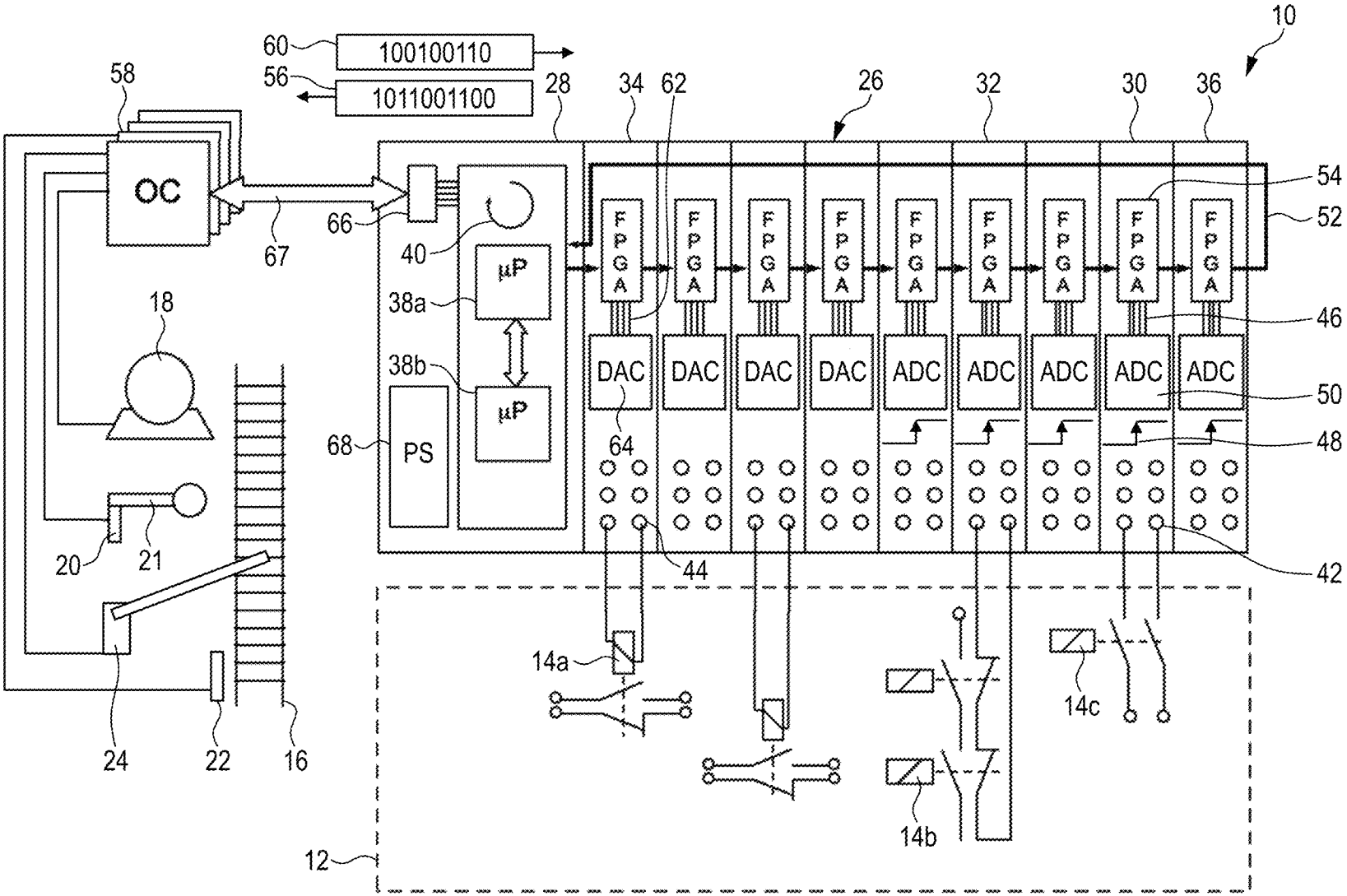
10
36
30
32
26
34
28
54
52
46
50
48
42
62
44
64
F
P
G
A
ADC
DAC
14c
14b
14a
100100110
1011001100
60
56
40
38a
38b
µP
µP
PS
66
68
12
67
16
22
OC
58
18
21
20
24

INTERFACE ADAPTER FOR CONTROLLING A TRACK-SIDE OBJECT OF A RAILWAY INSTALLATION

CROSS-REFERENCE TO RELATED APPLICATIONS

This application claims priority to EP App. No. 21216115.2 filed 20 Dec. 2021, the entire disclosure of which is incorporated by reference.

FIELD

The present disclosure relates to the field of railway traffic control and more particularly to a new interface adapter for controlling one or more track-side objects of a railway installation.

BACKGROUND

Controlling railway traffic is a challenging and safety-critical task for railway operators and for developers and suppliers of railway installations. Railway traffic is usually controlled using a plurality of signals and train detectors arranged along the railway tracks, and also using points (railroad switches) and level crossings or level crossing gates. A level crossing defines an intersection where railway tracks cross a road for cars or other road-related traffic at the same level. Typically, such track-side objects are electrically connected to what is called an interlocking. The interlocking receives and combines incoming status information from various sensors including the afore-mentioned train detectors and drives points, signals, level crossing gates etc. in order to safely control the railway traffic. Generally speaking, the interlocking is designed to control a plurality of track-side objects in such a manner that a train is not allowed to use a defined track section unless the track section to be used is proven safe.

Traditionally, an interlocking is implemented using a huge amount of electromechanical relays arranged in relay circuits so as to implement a defined control logic associated with the plurality of track-side objects. Each electromechanical relay basically provides an on-off switch that is electrically controlled so as to selectively allow voltage and/or electrical current to be supplied to a load or to be interrupted and thus be disconnected from the load. The load can either be the input side of another relay in the relay circuit, or it can be a track-side object to be controlled, such as a point or signal. The point has a moveable element that can be moved by an electrical motor and the electrical current required for driving the motor is traditionally supplied from the interlocking. Older signals also had moveable elements, but nowadays, signals typically comprise one or more lights, which may in the form of one or more LEDs.

Electromechanical relays have proven reliable and robust for decades. Due to their proven use in safety-critical railway installations, relay based interlockings are still widely in use, although it is more and more expensive and costly to run relay based interlockings for controlling railway traffic. An upgrade is difficult and cumbersome with a relay based interlocking because of the increasing complexity. Therefore, many thoughts and proposals have been made in order to replace relay based interlocking technology by more modern control technology without making concessions to the safety requirements.

By way of example, DE 10 2007 039 154 A1 discloses a safety system for a railway installation having a control center and field elements to be controlled. In order to simplify modernization or extension of such a safety system, a modular design is proposed, with the control center being in the form of a master, with the field elements being in the form of slaves, and with the master and the slaves being connected to one another via a communication system. The slaves are to be controlled via an additional controller, which can be connected to the communication system via a communication interface that is the same for all slaves.

U.S. Pat. No. 8,306,680 B2 discloses another arrangement for controlling a railway installation. A programmable control unit executes a user program in order to process input data from sensors and to generate control commands for actuators. The sensors and actuators are connected to a remote I/O unit, which is connected to the control unit via a communication network. The control unit and the I/O unit interchange data messages in order to transmit the input data and the control commands. The arrangement has a dedicated remote disconnection unit, which is coupled to the remote I/O unit separately from the input data and control commands. The control unit is designed to integrate specific verification data for the disconnection unit into the data messages for the I/O unit. The disconnection unit is designed to deactivate the I/O unit depending on the specific verification data.

In 2014, railway infrastructure operators of several European countries started an initiative called EULYNX. The initiative aimed at reducing cost and installation time of signaling equipment in railway installations. More particularly, interlockings are desired to be set up in modular fashion. It was intended to standardize the architecture and interfaces of railway signaling equipment. Dutch railway operator Pro Rail built a first EULYNX demonstrator, as described in a publication titled "ProRail and its industrial partners have built the first EULYNX demonstrator" by Monique Voorderhake, Frits Makkinga and Maarten van der Werff, published in SIGNALLING+DATACOMMUNICATION (111) 7+8/2019. According to this concept, the interlocking may be build using an industrial programmable logic controller (PLC) that communicates with a plurality of track-side objects via a communication protocol called RaSTA.

Swiss Railway operator SBB also published a concept for a new railway infrastructure based on the EULYNX initiative in a brochure titled "Grundkonzept fur den smartrail 4.0 Object Controller—Öffentliche Kurzversion" in December 2019.

These EULYNX concepts are promising with respect to what a new and modern railway infrastructure can achieve. However, they suffer from the fact that it is an enormous investment in terms of time and money to set up the EULYNX based railway infrastructure on a large scale basis while existing train traffic has to be kept operating and functional.

SUMMARY

Against this background, it is an object to provide an alternative approach for reducing costs and effort in the modernization of existing railway installations.

It is another object to provide an improved railway installation that can be implemented in a cost-effective manner while existing train traffic is kept operating and functional as far as possible.

It is yet a further object to facilitate the introduction of digitally controlled railway installations not only for small or local sites, but also on a regional or even national scale.

According to a first aspect, there is provided an interface adapter for controlling a track-side object of a railway installation, the interface adapter comprising at least one analog input configured to receive at least one of an analog input current or an analog input voltage from an external source, comprising at least one analog output configured to output at least one of an analog output current or an analog output voltage, the at least one of the analog output current or the analog output voltage being configured to drive at least one electromechanical relay circuit, comprising a bidirectional digital communication interface configured for communicating digital data according to a defined digital communication protocol, wherein the digital data comprises first digital data transmitted via the digital communication interface and comprises second digital data received via the digital communication interface, comprising an analog-to-digital converter coupled to the analog input and configured to generate a first digital signal representing the at least one of the analog input current or the analog input voltage, comprising a digital-to-analog converter coupled to the analog output and configured to generate the at least one of the analog output current or the analog output voltage in response to a second digital signal, comprising a programmable logic control circuit comprising a control program, and comprising a power supply, wherein the power supply is configured to supply electrical power at least to the digital-to-analog converter, wherein the control program is configured to produce the first digital data from the first digital signal and to transmit the first digital data using the digital communication interface, and wherein the control program is further configured to process the second digital data and to produce the second digital signal in response to the second digital data. Preferably, the digital communication protocol is a Rail Safe Transportation Application protocol as defined in German Standard DIN VDE V 0831-200 or European Standard EN 50159, respectively.

According to another aspect, there is provided a railway installation comprising a plurality of railway tracks, comprising a plurality of track-side objects, comprising an interlocking having a plurality of interconnected relays and implementing a defined control logic associated with the plurality of track-side objects in order to control railway traffic on the plurality of tracks, and comprising an interface adapter as mentioned above, wherein the interface adapter is connected to the interlocking via the at least one analog input and via the at least one analog output, and wherein the interface adapter is further connected to at least one track-side object from the plurality of track-side objects via the bidirectional digital communication interface.

According to yet another aspect, there is provided a method of modernizing an existing railway installation comprising a plurality of railway tracks, comprising a plurality of track-side objects selected from a group of points, signals, train detectors and level crossings, and comprising an existing interlocking having a plurality of interconnected relays and implementing a defined control logic associated with the plurality of track-side objects in order to control railway traffic on the plurality of tracks, the method comprising the steps of arranging a plurality of dedicated object controllers along the plurality of tracks and connecting a respective dedicated object controller from the plurality of dedicated object controllers with a respective track-side object from the plurality of track-side objects; arranging an interface adapter, as mentioned before, at the existing interlocking, interconnecting the interface adapter to at least one dedicated object controller from the plurality of dedicated object controllers using the bidirectional digital communication interface; interconnecting the interface adapter to the existing interlocking using the at least one analog input and the at least one analog output; controlling the existing railway installation using the at least one dedicated object controller from the plurality of dedicated object controllers and using the existing interlocking by communicating the digital data between the at least one dedicated object controller and the existing interlocking via the interface adapter; building a replacement interlocking in the vicinity of the existing interlocking, while the existing railway installation is controlled using the existing interlocking and the interface adapter, with the replacement interlocking comprising a further bidirectional digital communication interface configured for communicating the digital data according to the defined digital communication protocol, and with the replacement interlocking implementing a replacement control logic based on solid state controllers; interconnecting, once the replacement interlocking is built, the replacement interlocking to the plurality of object controllers using the further bidirectional digital communication interface; and removing the existing interlocking and the interface adapter.

Accordingly, there is proposed a new interface adapter that is designed and configured to individually connect a conventional relay-based interlocking to one or more track-side objects using a new digital data communication link, preferably as defined by the EULYNX initiative. Typically, the new digital data communication is based on a serial communication scheme. In other words, the new interface adapter allows to enhance a conventional relay-based interlocking such that the conventional relay-based interlocking becomes capable of communicating with track-side objects using the a digital communication standard. A new hybrid approach mixing conventional relay-based interlocking technology with a new digital data communication is thus proposed.

Heretofore, all concepts and proposals broad forward in connection with the EULYNX initiative aimed at replacing the existing relay-based interlocking together with the conventional analog cabling to the track-side objects in one conversion step. A EULYNX compatible communication scheme should therefore be introduced together with the replacement of existing interlocking technology. In other words, prior proposals and concepts were mainly focused on upgrading the existing interlocking by replacing the interlocking at the same time or within the same project when the track-side objects are also upgraded to the new concept. Briefly, this can be seen as an "all or nothing" approach.

In contrast, the present idea is based on a more sequential, step-by-step approach that starts with upgrading/modernizing the cable connections from an existing interlocking to the track-side objects, while the conventional interlocking is maintained operational even after a new digital and preferably EULYNX compatible communication scheme to the track-side objects is introduced. The new approach allows to build up and introduce the new communication structure in a step-by-step fashion without the huge investments required heretofore. Therefore, modernization can be made in smaller steps and, advantageously, while the existing train traffic is maintained with as few and as short interruptions as possible. Accordingly, the new approach allows a more cost-efficient conversion with shorter interruptions and less disturbance of the existing railway infrastructure. Acceptance and practical implementation are promoted. The above-mentioned object is completely achieved.

The power supply is configured to supply electrical power to the digital-to-analog converter, which means that the new interface adapter is capable of providing sufficient electrical power output for driving the relay input circuitry of the conventional interlocking. Preferably, the power supply is further configured to supply electrical power to the programmable logic control circuit and to the analog-to-digital converter. This facilitates electrical installation. Voltages at the at least one analog output may be in a range up to 24V DC or 60 V AC. Preferably, the at least one output is a three-phase output. The electrical and electronic components, in particular the analog-to-digital converter or the digital-to-analog converter, respectively, are advantageously configured to cope with electrical voltages and respective currents within these ranges. The bidirectional digital communication interface may advantageously be configured to allow digital communication via an optical fiber and/or communication via GSM-R, GSM generation 4 or 5 (4G or 5G).

In a preferred refinement, the interface adapter further comprises a threshold detector for detecting a defined threshold level of the at least one of the analog input current or the analog input voltage, wherein the control program is configured to produce the first digital data depending on the defined threshold level.

In this refinement, a threshold detector helps to convert the analog signals received at the at least one analog input into digital control information that can easily be integrated into the first digital data. Moreover, the threshold detector advantageously contributes to make the transformation from the current or voltage driven interlock to the digital control approach mire reliable and deterministic.

In another refinement, the interface adapter further comprises a device housing accommodating the programmable logic control circuit, the analog-to-digital converter, the digital-to-analog converter, and the power supply, wherein the device housing has a plurality of connecting terminals for connecting a plurality of wires, with the at least one analog input being associated with at least one respective first connecting terminal from the plurality of connecting terminals, and with the at least one analog output being associated with at least one respective second connecting terminal from the plurality of connecting terminals.

Advantageously, the new interface adapter according to this refinement is configured as a self-contained device that can easily be added to an existing interlocking at a location, where incoming and outgoing cabling to and from the track-side objects are present. The new interface adapter according to this refinement helps to reduce installation costs and to increase safety and reliability during installation and operation.

According to another refinement, the interface adapter comprises a plurality of analog inputs, wherein the control program is configured to produce a plurality of respective first digital data each associated with a respective one from the plurality of analog inputs, and to transmit the plurality of respective first digital data using the digital communication interface.

In this refinement, the new interface adapter can provide digital control data to a plurality of track-side objects, with each connected track-side object receiving associated control data from the existing interlocking. The refinement helps to further reduce costs and installation time and effort. In some preferred example embodiments, the plurality of track-side objects are serially connected to the interface adapter, which greatly helps to reduce installation costs. In some preferred example embodiments, the interface adapter comprises a plurality of analog-to-digital converters, with a respective analog-to-digital converter being associated with a respective analog input from the plurality of analog inputs, which facilitates fast data capture and high throughput in the control process.

According to yet another refinement, the interface adapter further comprises a plurality of analog outputs, wherein the control program is configured to process a plurality of respective second digital data received via the digital communication interface and to produce a plurality of respective second digital signals each associated with one from the plurality of respective second digital data. Preferably, the interface adapter comprises a plurality of digital-to-analog converters, with a respective digital-to-analog converter being associated with a respective analog out from the plurality of analog outputs.

This refinement also contributes to reduce costs and installation time and effort. A plurality of track-side objects can be connected to the interface adapter in order to provide a respective plurality of control input to the existing interlocking.

According to yet another refinement, the programmable logic control circuit employs a failsafe design. In particular, it may comprise a multi-channel redundancy.

This refinement involves that the interface adapter is designed in accordance with the requirements for functional safety in terms of International Standard IEC 61508. Preferably the requirements of at least one of European Standards EN 50126, EN 50128 or EN 50129, which define safety requirements for railway applications, are complied with. The refinement helps to further reduce costs and speed for the implementation of the new railway installation, because expense and effort for any safety analysis for the new railway installation is greatly reduced.

According to yet another refinement, the railway installation further comprises at least one dedicated object controller connected to the interface adapter via the bidirectional digital communication interface and connected to the at least one track-side object, wherein the at least one track-side object comprises a moveable element, and wherein the at least one dedicated object controller is configured to drive the moveable element. Preferably, there is a one-to-one relationship between a respective object controller and a respective track-side object. Any track-side object may therefore be controlled from the interlocking via a new interface adapter and via an associated dedicated object controller. The interface adapter and the dedicated object controller may also be connected to one another in a one-to-one relationship using the digital communication according to the EULYNX Standard, by way of example.

In this refinement, the dedicated object controller provides a track-side interface that is capable to generate a mechanical movement from and in response to the first digital data. Advantageously, the object controller comprises an object controller communication interface configured for communicating with the interface adapter according to the defined digital communication protocol as defined in the EULYNX initiative in order to communicate the digital data. In some preferred example embodiments, the dedicated object controller is configured to generate at least one of an analog drive current or an analog drive voltage that is dimensioned to effect movement of the moveable element of a conventional existing track-side object. More particularly, the dedicated object controller may advantageously be configured to move an existing point or level crossing gate in response to the first digital data. Further dedicated object controllers may be configured to drive signal lights in response to first digital data received from the conventional interlocking via the new interface adapter. The refinement helps to accelerate the transfer from the existing conventional railway installation to a more modern digitally controlled installation, because is facilitates to maintain the existing track-side objects in the new hybrid combination.

According to a refinement of the new method, a dedicated power supply line is installed along the plurality of track-side objects before or while the plurality of dedicated object controllers are arranged along the plurality of tracks, with the dedicated power supply line being configured for supplying electrical power to the plurality of dedicated object controllers. Preferably, the dedicated power supply line is routed to a power supply arranged in or in the vicinity of the existing interlocking so that the electrical power supply for the dedicated object controllers is provided from a location close to the existing interlocking.

The dedicated power supply line can advantageously replace or use the existing wire cabling to and from the existing interlocking in this refinement. The refinement helps to reduce installation costs and to speed up the conversion process.

According to yet another refinement of the method, an optical fiber communication cable is installed from the existing interlocking to the plurality of track-side objects before or while the plurality of dedicated object controllers are arranged along the plurality of tracks.

Preferably, the optical fiber communication cable is installed so as to build a loop or line connection connecting a plurality of track-side objects to the interface adapter in the existing interlocking. This refinement further helps to reduce installation costs and effort and to speed up the conversion process.

BRIEF DESCRIPTION OF THE DRAWINGS

It goes without saying that the features explained above and those yet to be explained below can be used not only in their respective combinations, but also in other combinations or on their own without departing from the scope of the present invention. Further features and details of example embodiments are explained below with respect to the drawing.

FIG. 1 shows an example embodiment of the new interface adapter in connection with some track-side objects and a conventional interlocking.

DETAILED DESCRIPTION

In FIG. 1, an example embodiment of a new railway installation is designated by reference number 10. The railway installation 10 comprises a conventional, relay-based interlocking 12 that is shown here in a schematic manner. Interlocking 12 comprises a plurality of electromechanical relays 14*a*, 14*b*, 14*c*, which are interconnected (not shown here for sake of simplicity) to form relay circuitry that implements a defined control logic in a manner known to the skilled person.

Example railway installation 10 further comprises a plurality of tracks 16 and a plurality of track-side objects, such as point 18 (shown here as an electrical drive that typically moves the moveable track element of the point), signal 20 having a moveable arm 21 or, more commonly nowadays, having one or more lights, train detector 22 and level crossing gate 24. The track-side objects are arranged along the tracks 16 in a manner known per se.

Example railway installation 10 further comprises an example embodiment of the new interface adapter, which is designated by reference number 26 here. In a preferred embodiment, interface adapter 26 has a modular design and comprises what is called here a head module 28 and a plurality of I/O (input and/or output modules) 30, 32, 34. The head module 28 and the I/O modules 30, 32, 34 may be configured so as to be arranged on a top hat rail of a control cabinet (not shown here). In the preferred embodiments, interface adapter 26 thus comprises a device housing 36, which can be made in one piece or in a plurality of housing modules, as it is shown here by way of example.

Interface adapter 26 comprises a programmable logic control circuit, which includes two microprocessors 38*a*, 38*b* in the present embodiment. Microprocessors 38*a*, 38*b* are arranged here in a manner so as to form a multi-channel redundant structure. Microprocessors 38*a*, 38*b* each cyclically execute a control program, which is indicated here at reference number 40. Microprocessors 38*a*, 38*b* further exchange data in order to mutually monitor each other to thereby establish a failsafe data processing. The two-channel redundant structure of interface adapter 26 is shown here as one preferred embodiment for establishing a failsafe logic control circuit. Other structural designs in accordance with the principles of functional safety as defined by International Standard IEC 61508 may be employed.

As is shown in FIG. 1, I/O modules 30, 32, 34 each comprise a number of connecting terminals, some of which are designated by reference numbers 42 and 44 by way of example. Still further by way of example, module 30 is an input module that provides an analog input configured to receive at least one of an analog input current or an analog input voltage from one or more respective outputs of interlocking 12. In a conventional railway installation, interlocking 12 provides an output current and/or output voltage at one of its respective outputs in order to drive a track-side object, such as point 18, signal 20 or level crossing 24. In the conventional railway installation, the respective output of interlocking 12 would be connected to the respective track-side object via one or more copper cables. In the present embodiment, however, the respective output of interlocking 12 is connected to one or more analog inputs of new interface adapter 26.

Input module 30 therefore comprises an input circuitry that is configured to receive the at least one of the analog output current or an analog output voltage from the respective output of interlocking 12, and to convert it to a first digital signal 46 that can be processed by programmable logic control circuit 38*a*, 38*b*. In the example embodiment shown, input module 30 comprises a threshold detector 48 and an analog-to-digital converter 50. Analog-to-digital converter 50 receives the analog output signal from interlocking 12, if the analog output signal exceeds a defined threshold level. Analog-to-digital converter 50 generates the first digital signal 46 in response thereto. First digital signal 46 is transmitted to programmable logic control circuit 38*a*, 38*b* via an internal communication bus 52 in this embodiment. By way of example, input module 30 may be connected to the internal communication bus 52 via an internal communication interface 54. The internal communication interface 54 may be implemented using a FPGA by way of example.

Programmable logic control circuit 38*a*, 38*b* receives the first digital signal 46 via the internal communication bus 52 and generates first digital data 56 that is subsequently transmitted to one or more object controllers 58 arranged in the vicinity of track-side objects 18, 20, 22, 24. In turn, programmable logic control circuit 38*a*, 38*b* receives second digital data 60 from one or more object controllers 58 and generates at least one second digital signal 62 in response thereto. The at least one second digital signal 62 is transmitted to at least one output module 34 via internal communication bus 52.

The at least one output module 34 comprises a digital-to-analog converter 64, which generates at least one of an analog output current or an analog output voltage in response to the second digital signal 62. The at least one of the analog output current or analog output voltage is then provided to interlocking 12 via a respective connecting terminal 44, as is shown in FIG. 1 by way of example.

In summary of the above, interface adapter 26 provides a bidirectional analog input and output interface for a conventional relay-based interlocking 12. Interface adapter 26 receives the analog output currents and/or output voltages from interlocking 12 and generates first digital data 56 in response thereto. Interface adapter 26 transmits the first digital data 56 via a bidirectional digital communication interface 66 to one or more object controllers 58 arranged in the vicinity of track-side objects 18, 20, 22, 24 such that the one or more object controllers 58 can drive one or more track-side objects in just the same manner as if the track-side objects were directly connected to conventional interlocking 12 via copper cables. In some preferred embodiments, a one to one relationship is established such that one respective interface adapter is connected to one respective object controller. Moreover, interface adapter 26 reads second digital data 60 from the one or more object controllers 58 via bidirectional digital communication interface 66 and generates one or more analog output currents and/or analog output voltages in response thereto using one or more digital-to-analog converters 64.

Interface adapter 26 provides the one or more analog output currents or analog output voltages to interlocking 12 in such a manner as if such analog output currents or analog output voltages were provided directly from the track-side objects 18, 20, 22, 24 via copper cables.

As indicated further above, bidirectional digital communication interface 66 may advantageously be configured to employ a digital communication protocol as defined in German Standard VDE V 0831-200 or European Standard EN 50159, respectively, namely a Rail Safe Transportation Application (RaSTA) protocol in accordance with the EULYNX initiative. Accordingly, European Standard EN 50159 and DIN VDE V 0831-200 are incorporated here by reference. Interface adapter 26 may thus communicate with the track-side object controllers 58 via the RaSTA communication protocol, which is a dedicated Ethernet-based communication protocol that can advantageously be used via an optical fiber communication cable 67.

Interface adapter 26 finally comprises a power supply, which is indicated schematically here at reference number 68. Power supply 68 is configured to supply electrical power to the at least one digital-to-analog converter 64, which means that power supply 68 is dimensioned to provide sufficient electrical power in order to drive the relay based input circuitry of interlocking 12. In preferred example embodiments, power supply 68 is further configured to provide any required operating voltages for the programmable logic control circuit 38*a*, 38*b* and for the analog-to-digital converters 50.

The phrase "at least one of A, B, and C" should be construed to mean a logical (A OR B OR C), using a non-exclusive logical OR, and should not be construed to mean "at least one of A, at least one of B, and at least one of C."

The invention claimed is:

1. An interface adapter for controlling a track-side object of a railway installation, the interface adapter comprising:

an analog input configured to receive an electrical input from an external source, wherein the electrical input includes at least one of an analog input current and an analog input voltage;

an analog output configured to output an electrical output to drive an electromechanical relay circuit, wherein the electrical output includes at least one of an analog output current and an analog output voltage;

a bidirectional digital communication interface configured to communicate digital data according to a defined digital communication protocol, wherein the digital data includes (i) first digital data transmitted via the digital communication interface and (ii) second digital data received via the digital communication interface;

an analog-to-digital converter coupled to the analog input and configured to generate a first digital signal representing the electrical input;

a digital-to-analog converter coupled to the analog output and configured to generate the electrical output in response to a second digital signal;

a programmable logic control circuit including a control program; and a power supply configured to supply electrical power at least to the digital-to-analog converter, wherein the control program is configured to:

produce the first digital data from the first digital signal, transmit the first digital data using the digital communication interface, process the second digital data, and produce the second digital signal in response to the second digital data.

2. The interface adapter of claim 1 further comprising:

a threshold detector configured to detect a defined threshold level of the electrical input, wherein the control program is configured to produce the first digital data depending on the defined threshold level.

3. The interface adapter of claim 1 further comprising:

a device housing accommodating the programmable logic control circuit, the analog-to-digital converter, the digital-to-analog converter, and the power supply, wherein the device housing includes a plurality of connecting terminals for connecting a plurality of wires, wherein the at least one analog input is associated with at least one respective first connecting terminal from the plurality of connecting terminals, and wherein the at least one analog output is associated with at least one respective second connecting terminal from the plurality of connecting terminals.

4. The interface adapter of claim 1 further comprising:

a plurality of analog inputs, wherein the control program is configured to:

produce a plurality of respective first digital data each associated with a respective one from the plurality of analog inputs, and transmit the plurality of respective first digital data using the digital communication interface.

5. The interface adapter of claim 1 further comprising:

a plurality of analog outputs, wherein the control program is configured to:

process a plurality of respective second digital data received via the digital communication interface, and produce a plurality of respective second digital signals each associated with one from the plurality of respective second digital data.

6. The interface adapter of claim 1 wherein the digital communication protocol is an Ethernet-based communication protocol used via an optical fiber communication cable.

7. The interface adapter of claim 1 wherein the digital communication protocol is a Rail Safe Transportation Application protocol as defined in German Standard DIN VDE V 0831-200 or European Standard EN 50159 respectively.

8. The interface adapter of claim 1 wherein the programmable logic control circuit employs a failsafe design.

9. The interface adapter of claim 8 wherein the programmable logic control circuit employs multi-channel redundancy.

10. A railway installation comprising:

a plurality of railway tracks;

a plurality of track-side objects;

an interlocking including a plurality of interconnected relays and implementing a defined control logic associated with the plurality of track-side objects in order to control railway traffic on the plurality of tracks; and an interface adapter including:

an analog input configured to receive an electrical input from an external source, wherein the electrical input includes at least one of an analog input current and an analog input voltage, an analog output configured to output an electrical output to drive an electromechanical relay circuit, wherein the electrical output includes at least one of an analog output current and an analog output voltage, a bidirectional digital communication interface configured to communicate digital data according to a defined digital communication protocol, wherein the digital data includes (i) first digital data transmitted via the digital communication interface and (ii) second digital data received via the digital communication interface, an analog-to-digital converter coupled to the analog input and configured to generate a first digital signal representing the electrical input, a digital-to-analog converter coupled to the analog output and configured to generate the electrical output in response to a second digital signal, a programmable logic control circuit including a control program, and a power supply configured to supply electrical power at least to the digital-to-analog converter, wherein the control program is configured to:

produce the first digital data from the first digital signal, transmit the first digital data using the digital communication interface, process the second digital data, and produce the second digital signal in response to the second digital data, wherein the interface adapter is connected to the interlocking via the at least one analog input and via the at least one analog output, and wherein the interface adapter is further connected to at least one track-side object from the plurality of track-side objects via the bidirectional digital communication interface.

11. The railway installation of claim 10 further comprising:

at least one dedicated object controller connected to the interface adapter via the bidirectional digital communication interface and connected to the at least one track-side object, wherein the at least one track-side object comprises a moveable element, and wherein the at least one dedicated object controller is configured to drive the moveable element.

12. The railway installation of claim 10 wherein the plurality of track-side objects includes at least one of signals arranged along the railway tracks, train detectors arranged along the railway tracks, points, and level crossings.

13. A method of modernizing an existing railway installation with a plurality of railway tracks and a plurality of track-side objects selected from a group of points, signals, train detectors and level crossings, the railway installation including an existing interlocking having a plurality of interconnected relays and implementing a defined control logic associated with the plurality of track-side objects in order to control railway traffic on the plurality of tracks, the method comprising:

arranging a plurality of dedicated object controllers along the plurality of tracks and connecting a respective dedicated object controller from the plurality of dedicated object controllers with a respective track-side object from the plurality of track-side objects;

arranging an interface adapter at the existing interlocking, wherein the interface adapter includes:

an analog input configured to receive an electrical input from an external source, wherein the electrical input includes at least one of an analog input current and an analog input voltage, an analog output configured to output an electrical output to drive an electromechanical relay circuit, wherein the electrical output includes at least one of an analog output current and an analog output voltage, a bidirectional digital communication interface configured to communicate digital data according to a defined digital communication protocol, wherein the digital data includes (i) first digital data transmitted via the digital communication interface and (ii) second digital data received via the digital communication interface, an analog-to-digital converter coupled to the analog input and configured to generate a first digital signal representing the electrical input, a digital-to-analog converter coupled to the analog output and configured to generate the electrical output in response to a second digital signal, a programmable logic control circuit including a control program, and a power supply configured to supply electrical power at least to the digital-to-analog converter, wherein the control program is configured to:

produce the first digital data from the first digital signal, transmit the first digital data using the digital communication interface, process the second digital data, and produce the second digital signal in response to the second digital data;

interconnecting the interface adapter to at least one dedicated object controller from the plurality of dedicated object controllers using the bidirectional digital communication interface;

interconnecting the interface adapter to the existing interlocking using the at least one analog input and the at least one analog output;

controlling the existing railway installation using the at least one dedicated object controller from the plurality of dedicated object controllers and using the existing interlocking by communicating the digital data between the at least one dedicated object controller and the existing interlocking via the interface adapter;

building a replacement interlocking in the vicinity of the existing interlocking, while the existing railway installation is controlled using the existing interlocking and the interface adapter, wherein:

the replacement interlocking includes a further bidirectional digital communication interface configured for communicating the digital data according to the defined digital communication protocol, and the replacement interlocking implements a replacement control logic based on solid state controllers;

interconnecting, once the replacement interlocking is built, the replacement interlocking to the plurality of object controllers using the further bidirectional digital communication interface; and removing the existing interlocking and the interface adapter.

14. The method of claim 13 wherein:

a dedicated power supply line is installed along the plurality of track-side objects before or while the plurality of dedicated object controllers are arranged along the plurality of tracks, and the dedicated power supply line supplies electrical power to the plurality of dedicated object controllers.

15. The method of claim 13 wherein an optical fiber communication cable is installed from the existing interlocking to the plurality of track-side objects before or while the plurality of dedicated object controllers are arranged along the plurality of tracks.

* * * * *